US007980183B2

(12) United States Patent
Meltser et al.

(10) Patent No.: US 7,980,183 B2
(45) **Date of Patent: *Jul. 19, 2011**

(54) ALTITUDE COMPENSATION SYSTEM FOR CONTROLLING SMOKE EMISSIONS FROM A NATURALLY ASPIRATED RAILROAD LOCOMOTIVE

(75) Inventors: Mikhail Meltser, Buffalo Grove, IL (US); Bryan Thomas Jett, Erie, PA (US); Neil Xavier Blythe, North East, PA (US); Ajith Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 674 days.

This patent is subject to a terminal disclaimer.

(21) Appl. No.: 11/678,211

(22) Filed: Feb. 23, 2007

(65) Prior Publication Data

US 2008/0202377 A1 Aug. 28, 2008

(51) Int. Cl.
*B61C 1/00* (2006.01)
*F02M 37/04* (2006.01)

(52) U.S. Cl. ..... 105/26.05; 123/501

(58) Field of Classification Search ..... 105/26.05, 105/27, 35, 49, 62.1, 73, 76; 123/26, 435, 123/436, 501, 679, 683, 704, 438
See application file for complete search history.

(56) References Cited

U.S. PATENT DOCUMENTS

| | | | | |
|---|---|---|---|---|
| 6,279,550 | B1 * | 8/2001 | Bryant | 123/559.1 |
| 6,552,439 | B2 * | 4/2003 | Dunsworth et al. | 290/41 |
| 6,725,134 | B2 * | 4/2004 | Dillen et al. | 701/19 |
| 7,055,504 | B1 * | 6/2006 | Gallagher et al. | 123/501 |

* cited by examiner

*Primary Examiner* — S. Joseph Morano
*Assistant Examiner* — Robert J McCarry, Jr.
(74) *Attorney, Agent, or Firm* — GE Global Patent Operation; John A. Kramer

(57) ABSTRACT

A railroad locomotive includes a naturally-aspirated reciprocating internal combustion engine, and a traction generator driven by the engine. A throttle position sensor produces a signal corresponding to the throttle position selected by the locomotive's operator. A load regulator receives a speed signal derived from the throttle position signal and outputs an excitation signal for the traction generator which is modified by a controller in response to air availability so that engine speed and load are controlled independently of the selected throttle position, so as to limit the exhaust smoke output of the engine.

15 Claims, 4 Drawing Sheets

| | | | | |
|---|---|---|---|---|
| THROTTLE SETTING | N5 | N6 | N7 | N8 |
| ENGINE SPEED | N6 | N7 | N8 | N8 |
| ENGINE OUTPUT STAGE 1 | N5 | N6 | N7 | N7 |
| ENGINE OUTPUT STAGE 2 | N5 | N6 | N6 | N6 |

Figure 4

ALTITUDE COMPENSATION SYSTEM FOR CONTROLLING SMOKE EMISSIONS FROM A NATURALLY ASPIRATED RAILROAD LOCOMOTIVE

BACKGROUND OF THE INVENTION

1. Field of the Invention

The present invention relates to a system for controlling smoke emissions from a a naturally aspirated locomotive by controlling the locomotive's air/fuel ratio and output in response to operation at barometric pressures characteristic of varying altitudes.

2. Disclosure Information

Naturally aspirated railroad locomotives typically are powered by compression ignition "diesel" engines. Such engines may be either four-stroke cycle or two-stroke cycle engines. Four-stroke naturally aspirated engines have no charge air booster such as a turbocharger or a supercharger. Two-stroke cycle diesel engines used in railroad locomotives are typically scavenged with a positive displacement blower such as a Roots-type blower. Notwithstanding the use of blower scavenging, such engines typically operate in a manner similar to naturally aspirated engines because the Roots blower or other type of positive displacement blower merely serves to force exhaust gases from the engine's cylinders at a pressure only slightly above atmospheric pressure, with the result that the airbox supplying the engine cylinders or intake manifold operates very closely to ambient air pressure.

Naturally aspirated railroad locomotives are, of course, subject to operation at altitude, and at higher altitudes, say above 2500 feet, operation may be characterized by production of excessive exhaust smoke. This smoke results from the lack of oxygen at higher altitudes.

Naturally aspirated locomotives are usually calibrated so that the engine powering the locomotive operates at one of eight throttle positions ("notches") characteristic of different engine speeds and loads. Accordingly, each notch is usually calibrated at a different air/fuel ratio, with notch 1, the lowest engine speed having the leanest air/fuel ratio or highest numerical air/fuel ratio, and notch 8 characterized by the highest engine speed and the richest, or lowest numerical air/fuel ratio. It is easily seen that if a naturally aspirated locomotive is operated at high altitude at the higher notches, e.g., 6, 7 and 8, smoking may occur due to the richer fuel calibration at the higher notches, coupled with lack of oxygen availability.

It would be desirable to control air/fuel ratio with minimal modification to the engine operating system commonly used on naturally aspirated locomotives, so as to reduce the production of smoke when the engine is operated at higher altitudes.

SUMMARY OF THE INVENTION

According to an aspect of the present invention, a railroad locomotive includes a naturally-aspirated reciprocating internal combustion engine normally operated at a plurality of predetermined throttle positions corresponding to a discrete engine speed and load points. A traction generator is driven by the engine. A throttle position sensor generates a throttle position signal corresponding to the throttle position selected by the locomotive's operator. A load regulator receives a speed signal derived from the throttle position signal and outputs an excitation signal for the traction generator. A controller receives at least the throttle position signal, the excitation signal, and an air availability signal, with the controller modifying the throttle position signal and the excitation signal in response to at least a value of the air availability signal, so that engine speed and load are controlled independently, based upon the selected throttle position, whereby exhaust smoke output of the engine will be mitigated.

According to another aspect of the present invention, the engine incorporated in a railroad locomotive may be either a four-stroke cycle diesel engine, or a blower-scavenged two-stroke cycle diesel engine. In either case, an engine governor controls both the load regulator and a fuel supply system for the engine, with the governor controlling the amount of fuel being supplied to the engine in response to the modified throttle position signal and the modified excitation signal.

According to an aspect of the present invention, the controller may optionally receive an ambient air temperature signal in addition to throttle position signal, excitation signal, and the air availability signal.

In general, according to another aspect of the present invention, the air availability signal corresponds to ambient barometric pressure.

According to another aspect of the present invention, the throttle positions correspond to predetermined engine speeds and air/fuel ratios, with the controller modifying the throttle position signal and the excitation signal so that the engine is operated at a greater engine speed and higher air/fuel ratio than the engine speed and air/fuel ratio normally associated with a given throttle position if the locomotive is operated at an air availability less than a predetermined air availability.

According to another aspect of the present invention, a method for controlling the air/fuel ratio of a naturally-aspirated reciprocating fuel injected internal combustion engine powering a traction generator in a railroad locomotive having a throttle with discrete, predetermined, operator-selectable throttle positions corresponding to predetermined engine speeds and loads includes monitoring the selected throttle position at which the locomotive is being operated, while determining air availability. If air availability decreases below an air availability threshold, the engine will be operated at a speed greater than the speed corresponding to the selected throttle position, while the quantity of fuel injected per stroke is reduced, so that the power of the engine is maintained in accordance with the selected throttle position, while increasing the air/fuel ratio so as to mitigate the amount of exhaust smoke produced by the engine. In essence, the power output of the engine will be pushed downward to the power output at a lower notch setting in some cases, thus establishing that the engine speed and load are controlled independently, based upon the selected throttle position.

According to another aspect of the present invention, smoke output of the engine is reduced by controlling engine speed and air/fuel ratio independently of the selected throttle positions, such that the air/fuel ratio may be moved to a more fuel-lean position than would otherwise be the case with fixed throttle notch positions corresponding to fixed engine speed and fixed load.

According to another aspect of the present invention, a method for modifying the air/fuel ratio control of a naturally aspirated reciprocating internal combustion engine powering a traction generator in a railroad locomotive having a manually settable throttle with a plurality of positions corresponding to predetermined engine speeds and engine loads, so as to control smoke caused by varying air availability, includes providing a single control module having an air availability sensing device and a throttle position monitor, and determining a desired engine speed and desired load, based upon the throttle setting and sensed air availability. The controller will modify a main generator excitation signal in response to the desired load and transmit the modified excitation signal to the traction generator to control the engine load, while controlling the engine speed to the desired engine speed.

It is an advantage of a method and system according to the present invention that excessive smoke emissions of a naturally aspirated railroad locomotive may be controlled without the need for costly aftertreatment devices.

It is yet another advantage of the present invention that smoke emissions may be controlled without the need for costly retrofitting of modified fuel injection hardware.

It is yet another advantage of a method and system according to the present invention that smoke emissions may be limited without causing deration while operating at low to moderate altitudes and at lower to moderate throttle settings.

Other advantages, as well as features of the present invention, will become apparent to the reader of this specification.

BRIEF DESCRIPTION OF THE DRAWINGS

FIG. 4 is a table showing the result of engine control adjustments according to an aspect of the present invention.

DETAILED DESCRIPTION OF THE PREFERRED EMBODIMENT

Figure 1:
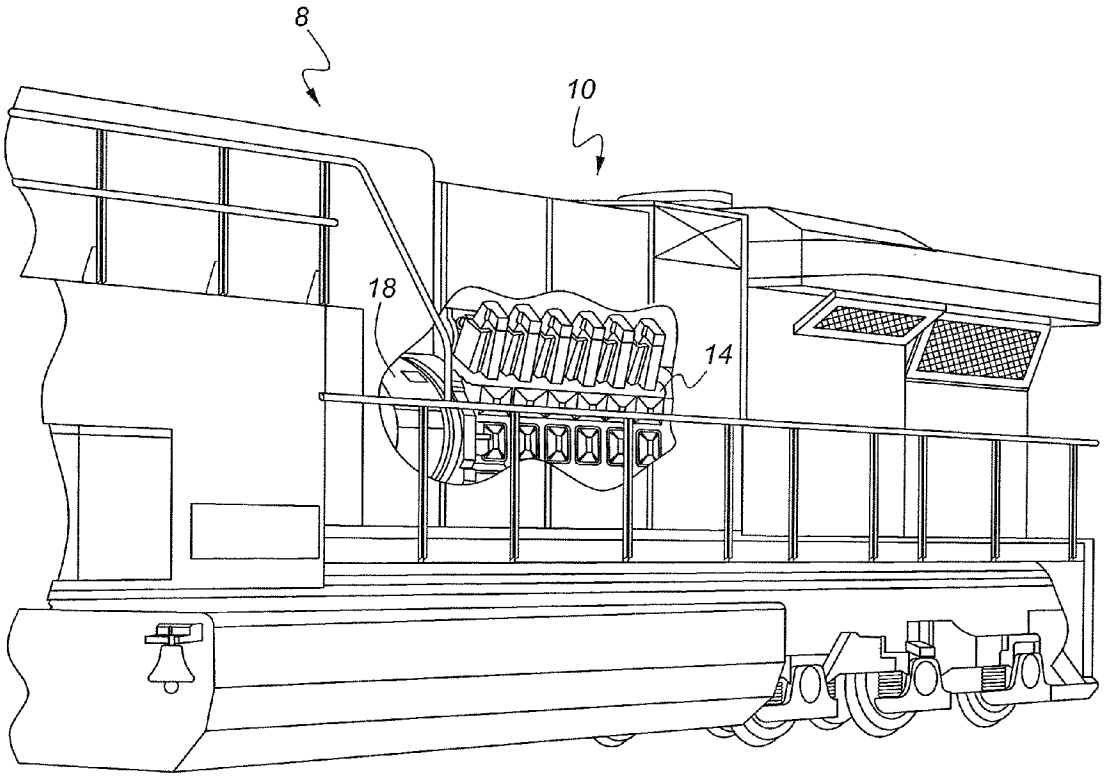
FIG. 1 is a perspective view of a railroad locomotive having an engine control system according to the present invention.

As shown in FIG. 1, railroad locomotive 10 has a naturally aspirated reciprocating internal combustion engine 14, which may comprise either a four-stroke cycle diesel engine, or a blower-scavenged two-stroke cycle diesel engine, or other type of reciprocating internal combustion engine suitable for use with the present invention. Thus, as used herein, the term "naturally aspirated" refers to either a four-stroke cycle engine without any type of charge air booster, or a two-stroke cycle engine using blower scavenging.

Engine 14 drives a traction generator 18, which provides electrical power for operating locomotive 10. As used herein, the term "generator" means a rotating electrical machine which may be constituted as either a generator or an alternator.

Figure 2:
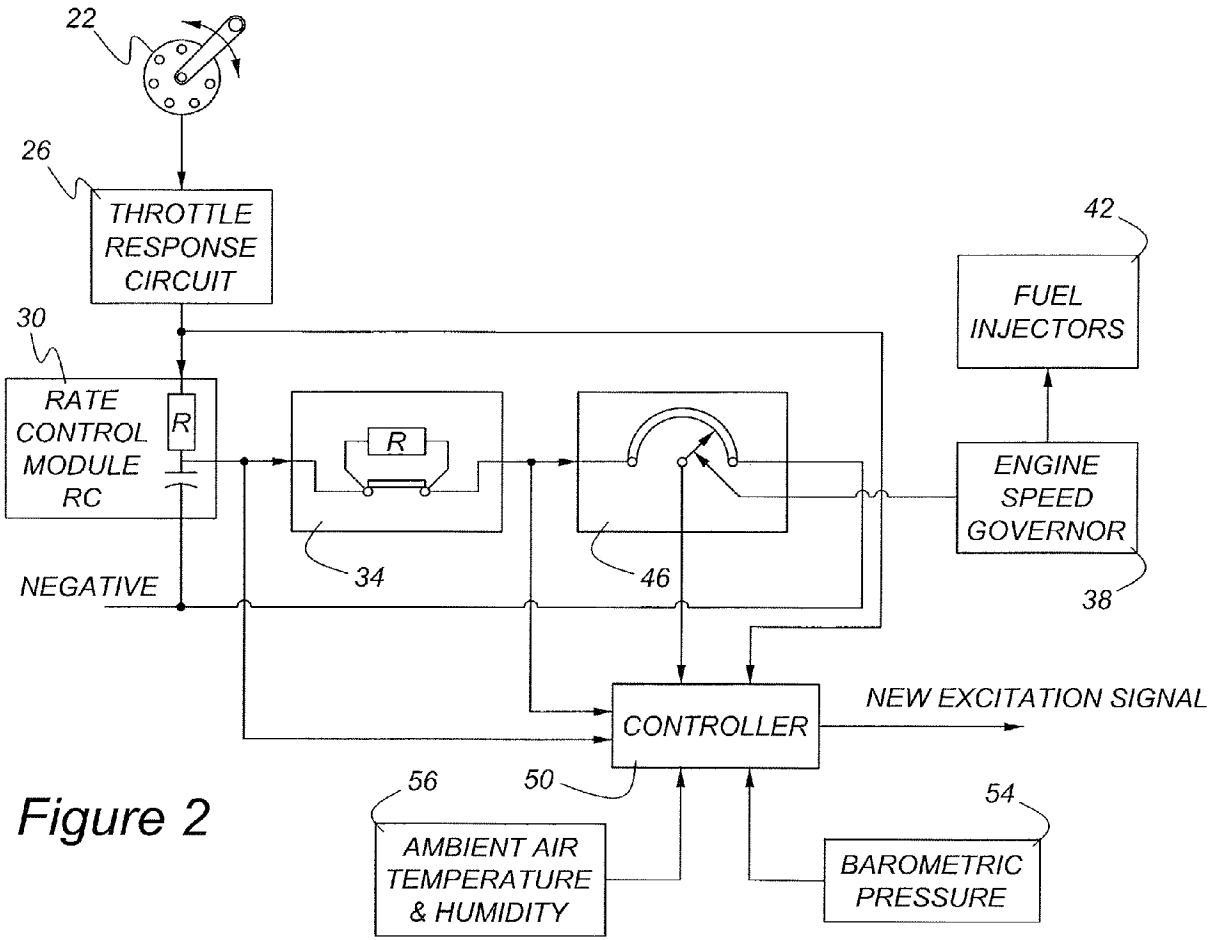
FIG. 2 is a schematic representation of a portion of a control system according to the present invention.

FIG. 2 illustrates a control system in which the operator of the locomotive positions a throttle, typically, at one of eight notches. The throttle's position is read by throttle position sensor 22, which outputs a signal to throttle response circuit 26. In turn, throttle response circuit 26 outputs a notch reference signal to a controller 50. Throttle response circuit 26 also feeds a signal to rate control module 30, which allows the output from throttle response circuit 26 to be ramped up and sent to wheel slip module 34. The purpose of wheel slip module 34 is to modify the output of rate control module 30 in the event that wheel slip is sensed. In general, throttle response circuit 26, rate control module 30, and wheel slip module 34 are components commonly used in known railroad locomotives.

The output of wheel slip module 34 is sent as a modified throttle or speed signal, to controller 50 and also to load regulator 46, which is a potentiometer controlled by engine speed governor 38. Governor 38 also controls fuel injectors 42 to maintain engine speed at the specified notch setting. The output of load regulator 46 is an excitation signal which is sent to generator 18. This excitation signal determines the load imposed by generator 18 upon engine 14.

Controller 50 receives the output of load regulator 46 and modifies the excitation signal in response to at least the value of the barometric pressure signal from sensor 54. Controller 50 also may receive inputs from ambient air temperature and humidity sensors, which are included in a bundle of sensors, 56. Controller 50 may be constituted as either a microprocessor based controller, or an analog controller, or a relay logic panel, or other type of controller known to those skilled in the art of machine and engine control and suggested by this disclosure.

Figure 3:
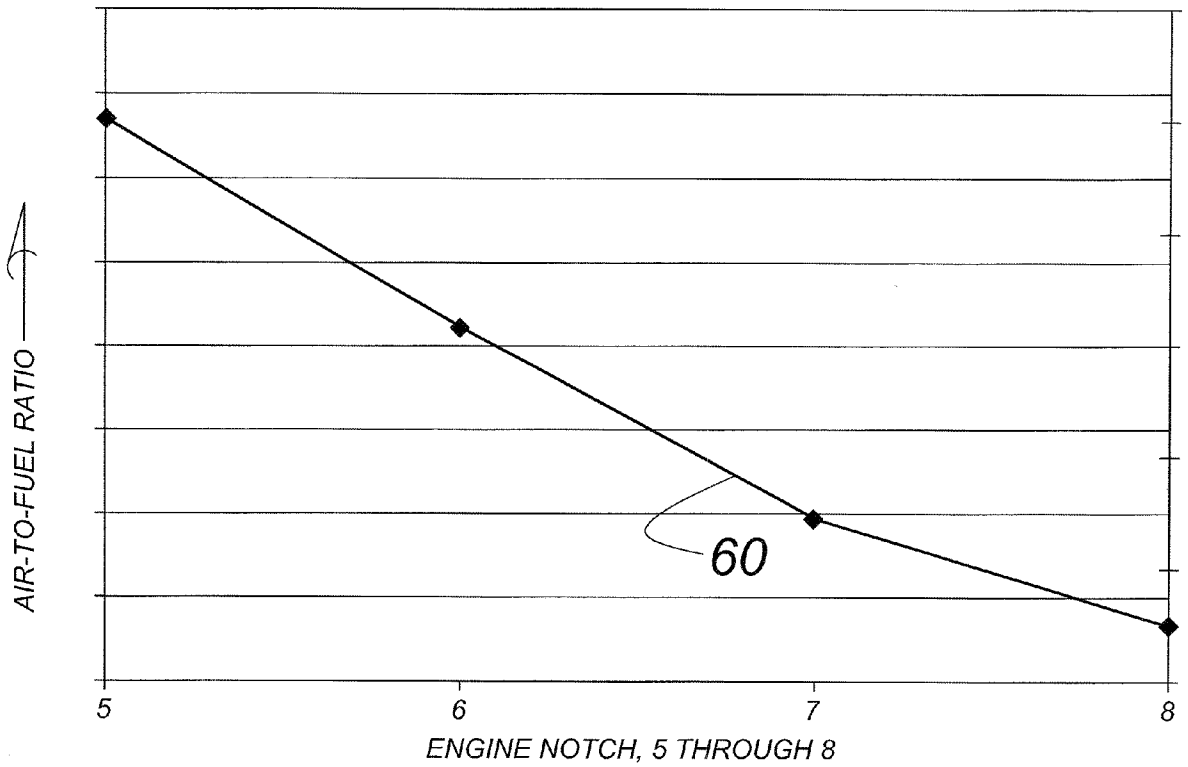
FIG. 3 is a plot showing discrete combined engine air/fuel ratio and speed operating points which are adjusted according to an aspect of the present invention.

As shown in FIG. 3, naturally aspirated railroad locomotives are typically operated at a variety of throttle notches, and for one particular locomotive, notches 5 through 8 are shown. Each notch corresponds to a defined engine speed. Additionally, notice from curve 60 that each notch is characterized by different air/fuel ratio, with the most fuel rich ratio being at notch 8 and the most fuel lean ratio being at notch 5. Notches 1-4 (not shown) would have correspondingly lower air/fuel ratios and lower engine output. This follows usual practice, because the highest engine speed and lowest practicable air/fuel ratio give the greatest power output. Thus, curve 60 of FIG. 3 depicts preset air/fuel ratio as a function of notch (engine speed).

FIG. 4 is a table showing the result of engine control adjustments according to the present invention. Controller 50 monitors air availability, as well as the selected throttle position at which locomotive 10 is being operated. Air availability may be measured as by measuring ambient barometric pressure with sensor 54, or by measuring or determining a surrogate for barometric pressure, through the use of sensors 56. Such surrogates include pressure within an engine inlet manifold, engine crankcase, or the temperature of a fan-cooled device. Other surrogates for air availability include calculated availability from global position sensing, measured ambient oxygen concentration, and even a reading from a manual switch indicating high altitude operation. Yet other surrogates include measured smoke opacity and normalized exhaust temperature.

Regardless of the method used to determine air availability, controller 50 will act to reduce air/fuel ratio when air availability decreases below a threshold value. Throttle setting, or position, is used as a first input to the table of FIG. 4. At notches N5 and N6, engine speed is increased to the next highest notch speed, namely notches N6 and N7, respectively. This speed increase is produced when controller 50 sends a signal to governor 38 to cause governor 38 to increase the speed of engine 14, notwithstanding that the notch requested by the locomotive operator remains at N5, or N6, as the case may be. Operating engine 14 at an increased speed makes more air available for combustion per unit of time, which permits power output to be maintained with less smoke at lower notch settings because controller 50 adjusts the output of load regulator 46, so that the load imposed by traction generator 18 upon engine 14 is reduced, which has the effect of increasing the air/fuel ratio and decreasing smoke emissions.

The table of FIG. 4 includes two altitude, or air availability stages. Stage 1 corresponds to a first air availability threshold, for example, 2500 ft., but less than a second air availability threshold, say 4500 ft. Stage 2 corresponds to altitudes greater than 4500 ft. Those skilled in the art will appreciate in view of this disclosure that these threshold altitudes, or air availabilities will vary for different locomotives.

At throttle setting N5 of FIG. 4, output is limited to N5 for both Stage 1 and Stage 2. This output is achieved at an engine speed of N6. At throttle setting N6, output of N6 is achieved at an engine speed of N7, again for both stages. Deration is not needed for notches N5 and N6 because these notches require only moderate power output. Unlike the case with throttle settings at notches N5 and N6, when the throttle is set at notch N7, and with the speed at N8, output is maintained at N7 for Stage 1, but the lower air availability at Stage 2 requires duration to output N6, so as to limit smoke production. At throttle setting N8, deration becomes more severe, because at Stage 1, output is limited to N7, and at Stage 2, output is limited to N6.

FIG. 4 demonstrates that the present system controls engine speed and load essentially independently of notch position at certain operating conditions.

As noted above, a number of surrogates may be employed to substitute for an unvarnished barometric pressure signal. In essence barometric pressure is a measure of air or, more importantly, oxygen availability. In turn, air availability is a surrogate for oxygen availability. Air availability may be determined by a number of methods including: measuring pressure within an inlet manifold associated with said engine; by measuring pressure within a crankcase associated with the engine; by measuring output pressure of a cooling system blower located within the locomotive; by global position sensing and associated lookup of altitude; by measuring the temperature of the exhaust of the engine and ambient temperature; by measuring ambient oxygen concentration; by measuring of exhaust smoke opacity, or by means of a manually activated high-altitude switch.

According to another aspect of the present invention a railroad locomotive may be modified to operate according to the present invention by providing a single unit control module incorporating air availability sensing and throttle position monitoring. The control module will determine a desired engine speed and desired load, drawn from the population of predetermined speeds and loads, as shown in FIG. 4, based upon the throttle setting and sensed air availability. The main generator excitation signal will be modified in response to the desired load, and the modified excitation signal will be transmitted to the traction generator to control the engine load, while controlling the engine speed to the desired engine speed.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. A method for controlling the air/fuel ratio of a naturally aspirated, reciprocating, fuel-injected internal combustion engine powering a traction generator in a railroad locomotive having a throttle with discrete, predetermined, operator-selectable throttle positions corresponding to predetermined engine speeds and loads, comprising:

monitoring the selected throttle position at which the locomotive is being operated;

determining air availability;

if the air availability decreases below an first air availability threshold, operating the engine at a predetermined speed greater than the speed corresponding to the selected throttle position, and reducing the quantity of fuel injected per stroke, so that the power output of the engine is maintained in accordance with the selected throttle position while increasing the air/fuel ratio, so as to mitigate the amount of exhaust smoke produced by the engine.

2. A method according to claim 1, further comprising operating the engine at a predetermined speed greater than the speed corresponding to the selected throttle position, while adjusting the quantity of fuel injected, so that the power output of the engine is decreased from power output corresponding to the selected throttle position to a predetermined lower power output, if the air availability decreases below a second air availability threshold.

3. A method according to claim 1, wherein air availability is determined by measuring barometric pressure.

4. A railroad locomotive according to claim 1, wherein said engine comprises a four-stroke cycle diesel engine.

5. A railroad locomotive according to claim 1, wherein said engine comprises a blower-scavenged, two-stroke cycle diesel engine.

6. A method according to claim 1, wherein air availability is determined by measuring pressure within an inlet manifold associated with said engine.

7. A method according to claim 1, wherein air availability is determined by measuring pressure within a crankcase associated with said engine.

8. A method according to claim 1, wherein air availability is determined by measuring the temperature of a component cooled by a blower located within the locomotive.

9. A method according to claim 1, wherein air availability is determined by a lookup table procedure using global position sensing.

10. A method according to claim 1, wherein air availability is determined from measurements of the temperature of the exhaust of said engine and ambient temperature.

11. A method according to claim 1, wherein air availability is determined from measurements of ambient oxygen.

12. A method according to claim 1, wherein air availability is determined from measurements of exhaust smoke opacity.

13. A method according to claim 1, wherein air availability is determined by an operator activating a manual switch.

14. A railroad locomotive, comprising:

a naturally-aspirated, reciprocating internal combustion engine normally operated at a plurality of predetermined throttle positions corresponding to discrete engine speed and load points;

a traction generator driven by said engine;

a throttle position sensor for generating a throttle position signal corresponding to the throttle position selected by the locomotive's operator;

a load regulator for receiving a speed signal derived from said throttle position signal, with the load regulator outputting an excitation signal for said traction generator; and a controller for receiving at least said throttle position signal, said excitation signal, and an air availability signal, with said controller modifying said throttle position signal and said excitation signal in response to at least the value of said air availability signal, so that engine speed and load are controlled independently, based upon the selected throttle position, wherein said controller receives an ambient air temperature signal, in addition to said throttle position signal, said excitation signal, and said air availability signal.

15. A railroad locomotive, comprising:

a naturally-aspirated, reciprocating internal combustion engine normally operated at a plurality of predetermined throttle positions corresponding to discrete engine speed and load points;

a traction generator driven by said engine;

a throttle position sensor for generating a throttle position signal corresponding to the throttle position selected by the locomotive's operator;

a load regulator for receiving a speed signal derived from said throttle position signal, with the load regulator outputting an excitation signal for said traction generator; and a controller for receiving at least said throttle position signal, said excitation signal, and an air availability signal, with said controller modifying said throttle position signal and said excitation signal in response to at least the value of said air availability signal, so that engine speed and load are controlled independently, based upon the selected throttle position, whereby the exhaust smoke output of the engine will be mitigated;

wherein each of said throttle positions corresponds to a predetermined air/fuel ratio, with said controller modifying said throttle position signal and said excitation signal so that the engine is operated at a greater engine speed and higher air/fuel ratio than the engine speed and air/fuel ratio normally associated with a given throttle position if the locomotive is operated at an air availability less than a predetermined air availability threshold.

* * * * *